313-414
8/28/84 XR 4,468,587

United States Patent [19]

Sluyterman

[11] Patent Number: 4,468,587

[45] Date of Patent: Aug. 28, 1984

[54] PICTURE DISPLAY DEVICE WITH QUADRUPOLE LENSES

[75] Inventor: Albertus A. S. Sluyterman, Eindhoven, Netherlands

[73] Assignee: U.S. Philips Corporation, New York, N.Y.

[21] Appl. No.: 342,328

[22] Filed: Jan. 25, 1982

[30] Foreign Application Priority Data

Feb. 18, 1981 [NL] Netherlands ..... 8100785

[51] Int. Cl.[3] ..... H01J 29/56; H01J 29/64

[52] U.S. Cl. ..... 313/413; 313/414; 313/431; 313/442

[58] Field of Search ..... 313/442, 443, 431, 449, 313/413, 414, 440

[56] References Cited

U.S. PATENT DOCUMENTS 3,946,266 3/1976 Saito et al. ..... 313/442

4,310,776 1/1982 Duys ..... 313/443 X

*Primary Examiner*—Palmer C. Demeo

*Attorney, Agent, or Firm*—Thomas A. Briody; William J. Streeter

[57] ABSTRACT

In a device for displaying pictures with a display tube and a self-converging system of deflection coils, the focusing in the direction in which the focusing is substantially independent of the deflection by the system of the deflection coils is effected by means of two quadrupole lenses and in the direction at right angles thereto by the focusing lens. This makes it possible to use dynamic focusing in said latter direction without defocusing in another direction and to obtain a sharp spot all over the screen. By providing an octupole lens coaxially around the electron beam and the center of the focusing lens it also becomes possible to reduce the spherical aberration.

14 Claims, 13 Drawing Figures

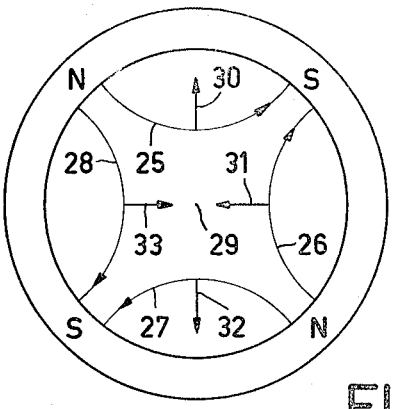
FIG.3
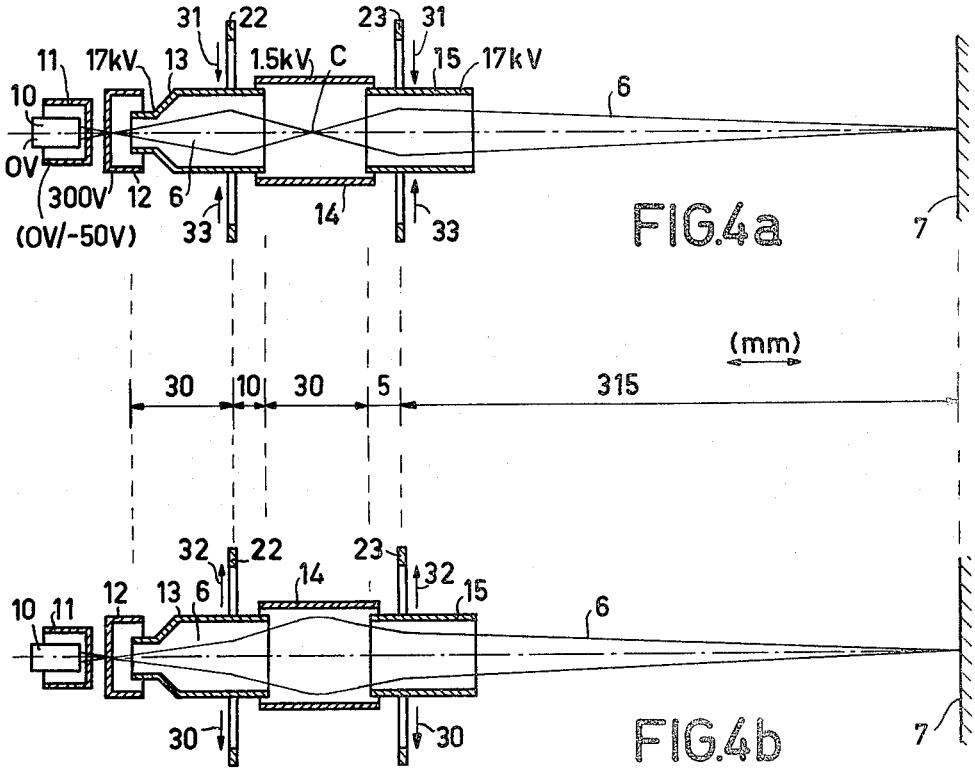
FIG.4a
FIG.4b

PICTURE DISPLAY DEVICE WITH QUADRUPOLE LENSES

BACKGROUND OF THE INVENTION

1. Field of the Invention

The invention relates to a picture display device comprising a display tube having a system of deflection coils, which display tube comprises an evacuated envelope having therein an electron gun for generating at least one electron beam and a display screen, which electron beam is focused on the display screen by means of a focusing lens, over which display screen the electron beam is deflected in two mutually perpendicular directions by means of the system of deflection coils.

Such a device is used for projection television, for displaying monochromatic and colour television pictures and for displaying letters, digits, symbols and figures in one or more colours. Tubes for such devices are available in very many constructions and are manufactured on a very large scale.

2. Description of the Prior Art

Such a device is known inter alia from chapter I of the book "Electron Optics in Television" Pergamon Press, Oxford 1961. In such devices it is known that the spot of the electron beam on the display screen in the centre of said display screen has different dimensions from the spot of the deflected electron beam which is situated at the edge of the display screen. This effect which is the result of curvature of the image field and astigmatism is termed deflection defocusing and leads to less sharp pictures on a part, for example, the edge, of the display screen. This is annoying in particular when letters, digits and symbols are displayed. In colour display tubes having three electron beams convergence problems occur in addition due to said deflection defocusing.

So-called self-converging systems of deflection coils have been designed in which, as described in U.S. Pat. No. 2,866,125 and which is incorporated by reference in this Application, a ribbon-shaped electron beam remains focused on the display screen during the deflection. In colour display tubes said ribbon-shaped electron beam is in practice often formed by three sub-electron beams situated in one plane. This beam must be ribbon-shaped, in other words, must have a small dimension in one direction, because otherwise upon deflection extra deflection focusing occurs. A property of such a system is that in the direction of the plane of the ribbon the focusing, that is the adjustment of the focusing lens in which the spot in that direction has a minimum dimension, is substantially not dependent on the deflection.

In practice the electron beam emanating from one electron gun has by no means an infinitely small cross-section and often is circular. The problem of the deflection defocusing is still present "microscopically" (hence considered per electron beam) in the direction perpendicular to the plane of the ribbon in such self-converging deflection coil systems. Dynamic focusing does not provide a solution to this problem because dynamic focusing in one direction automatically involves defocusing in the other direction.

It is therefore an object of the invention to provide a solution to this problem and to provide a device in which the focusing in two mutually perpendicular directions is independent.

Another object of the invention is to provide a device in which it is possible in a comparatively simple manner to reduce the spherical aberration of the electron beam.

SUMMARY OF THE INVENTION

According to the invention, a device of the kind mentioned in the opening paragraph is characterized in that the system of deflection coils is a self-converging system of deflection coils and viewed in the direction of propagation of the electron beam a first quadrupole lens is provided around the electron beam in front of the focusing lens, said first quadrupole lens focusing the electron beam in a first direction in the centre of the focusing lens, said first direction coinciding substantially with the direction in which the focusing is substantially independent of the deflection by the system of deflection coils, and after the focusing lens a second quadrupole lens is provided which focuses the electron beam in the first direction on the display screen so that the focusing in said first direction takes place substantially by the two quadrupole lenses and by the focusing lens in the direction perpendicular thereto. Application of dynamic focusing with the focusing lens then has substantially no influence on the focusing by the two quadrupole lenses because the electron beam is focused in said first direction in the centre of the focusing lens. As a result of this the electron beam in said direction has such a small dimension that influencing by the focusing lens hardly occurs. The focusing lens may be a magnetic or an electrostatic focusing lens.

Because the focusing lens exerts a focusing influence on the electron beam only in one direction, it is possible for the focusing lens to also be a quadrupole lens which is rotated 90° with respect to the said two quadrupole lenses. Such focusing lenses are known per se from chapter 4 of the already mentioned "Electron Optics in Television".

The quadrupole lenses may be electrostatic quadrupole lenses. In a first preferred embodiment of a device in accordance with the invention the quadrupole lenses are magnetic quadrupole lenses because therewith true quadrupole lenses can easily be made which only generate a quadrupole field.

A second preferred embodiment of a device in accordance with the invention is characterized in that the magnetic quadrupole lens consists of a ring of permanent magnetic material magnetized as a quadrupole and provided around the electron beam. Such rings magnetized as a multipole are already known from German patent application No. 26126078 (PHD 76.060) laid open to public inspection. The magnetic quadrupole lenses in a device in which only one electron beam is generated may be provided both inside and outside the display tube. In a colour display tube the said quadrupole lenses are preferably provided inside the tube around at least one of the electron beams.

A third embodiment of a device in accordance with the invention in which only one electron beam is generated is characterized in that the magnetic quadrupole lens consist of two rings of permanent magnetic material magnetized as a quadrupole and which can be rotated relative to each other. These magnetic quadrupole lenses are provided around the neck of the display tube and are adjustable so that, also with a different adjustment of the potentials on the electrodes of the electron gun, focusing can be done accurately in the centre of the focusing lens and on the display screen.

Since in a device in accordance with the invention the electron beam in the centre of the focusing lens is ribbon-shaped, the spherical aberration can simply be reduced by means of a magnetic octupole lens. For that purpose, according to a preferred embodiment of the invention, a magnetic octupole lens is provided coaxially around the electron beam viewed in the direction of propagation of the electron beam at the level of the centre of the focusing lens, which octupole lens has a defocusing effect in the said first direction and has a stigmator action.

The place and the operation of such an octupole lens will be described in greater detail with reference to FIGS. 10, 11 and 12.

A device in accordance with the invention is particularly suitable for use for displaying alphanumerical characters, symbols and figures, because the spot remains very small all over the screen so that a very sharp picture can be displayed all over the screen.

A device in accordance with the invention permits of using an electron beam having a large diameter without being hindered by astigmatism of the system of deflection coils as described in U.S. Pat. No. 2,866,125. Beams having a large diameter are preferably used in projection television tubes. Therefore the invention is also particularly suitable for use in projection television tubes.

Embodiments of the invention will now be described in greater detail, by way of example, with reference to the accompanying drawing.

DESCRIPTION OF THE PREFERRED EMBODIMENTS

Figure 1:
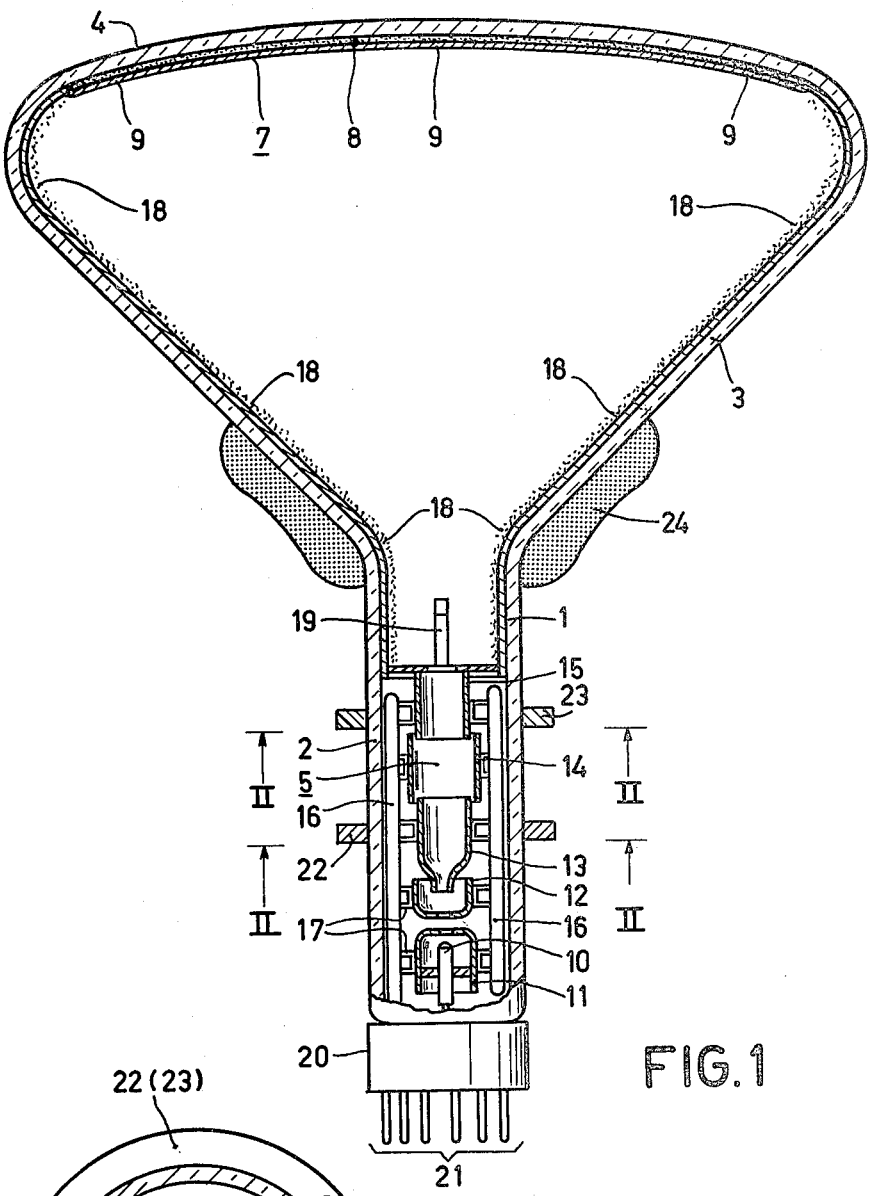
FIG. 1 is a longitudinal sectional view of a device according to the invention.

The device shown in FIG. 1 comprises a glass envelope 1 consisting of a neck 2, a cone 3 and a display window 4. Provided in the neck is an electron gun 5 to generate an electron beam 6 (not shown) which is incident on a display screen 7 which is provided on the inside of the display window 4. The display screen consists of a phosphor layer 8 which is covered with a thin aluminium film 9. The electron gun 5 comprises a cathode 10, a first electrode 11, a second electrode 12 and a focusing lens formed by the electrodes 13, 14 and 15. These electrodes are connected to glass assembly rods 16 by means of U-shaped assembly braces 17 which are connected to the electrodes and which are sealed in the glass rods. An electrically conductive coating 18 is electrically connected to the aluminium film 9 and electrode 15, by means of a number of contact springs 19 which are connected to electrode 15. Electrode 13 is electrically connected to electrode 15. The neck 2 comprises a cap 20 having a number of connection pins 21 which via glass leadthroughs are connected to the electrodes and which serve to apply the correct potential to the electrodes. According to the invention, two magnetic quadrupole lenses 22 and 23 are provided around the neck 2. The electron beam is focussed in one direction in the centre of the focusing lens by means of quadrupole lens 22 and then focused on the display screen by means of quadrupole lens 23. The electron beam is deflected over the display screen in two mutually perpendicular directions by means of the self-converging system of deflection coils 24 which is provided around the neck-cone transition. The direction in which the quadrupole lens is focused coincides with that direction in which the focusing is substantially independent of the deflection by the system of deflection coils.

Figure 2:
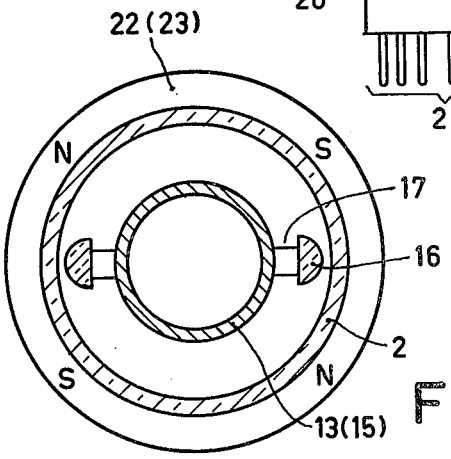
FIG. 2 is a cross-sectional view on the lines II—II of the device shown in FIG. 1, FIG. 3 further explains the operation of a magnetic quadrupole lens, FIGS. 4*a* and *b* are longitudinal sectional views of an electron gun and the shape of the electron beam in the device shown in FIG. 1, FIGS. 5 and 6 are a sectional view and an elevation, respectively, of an adjustable magnetic quadrupole lens.

FIG. 2 is a cross-sectional view of the tube shown in FIG. 1. The quadrupole lenses are provided coaxially around the electrodes 13 and 15. The operation of these magnetic quadrupole lenses will be described in detail with reference to FIG. 3. A magnetic field of which a few field lines 25, 26, 27 and 28 are shown is obtained by four magnet poles which are cyclically magnetized north-south-north-south (N-S-N-S). A diverging electron beam the axis of which coincides with axis 29 of the quadrupole lens and the electrons of which move backwards at right angles to the plane of drawing experiences the forces denoted by the arrows 30, 31, 32 and 33. As a result of this, the diverging electron beam becomes more strongly diverging in one direction and converging in the direction at right angles thereto.

As shown in FIG. 4*a*, the first magnetic quadrupole lens 22 is chosen to be so strong that the electron beam 6 of which only the lines of intersection of the plane of the drawing with the beam envelope are shown, is focused in one direction (for example horizontal) in the centre C of the focusing lens. The electron beam is then focused on the display screen 7 by the magnetic quadrupole lens 23.

As is shown in FIG. 4*b*, the quadrupole lens 22 has a defocusing effect in the direction at right angles to the mentioned direction of FIG. 4*a*. By means of the electrostatic focusing lens which comprises the electrodes 13, 14 and 15, and the magnetic quadrupole lens 23 the electron beam 6 is also focused on the display screen.

Hence the focusing in one direction (FIG. 4*a*) takes place substantially by the two magnetic quadrupole lenses 22 and 23, while in the direction at right angles thereto (FIG. 4*b*) focusing is also carried out with the focusing lens.

The distance between the various electrodes mutually and the quadrupole lenses and the display screen are shown in mm between the FIGS. 4*a* and 4*b*. The diameter of the electrodes 13 and 15 is 18 mm and the diameter of electrode 14 is 20 mm. Usual applied potentials are also shown in FIGS. 4*a* and 4*b*.

Dynamic focusing can be used in one direction by means of the focusing lens, without therewith disturbing the focusing in the other direction. It has become possible to substantially compensate for the astigmatism of the deflection coils so that a comparatively small spot is obtained over the whole display screen.

Figure 5:
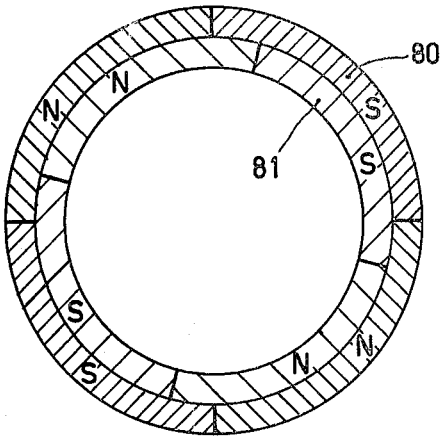
Figure 6:
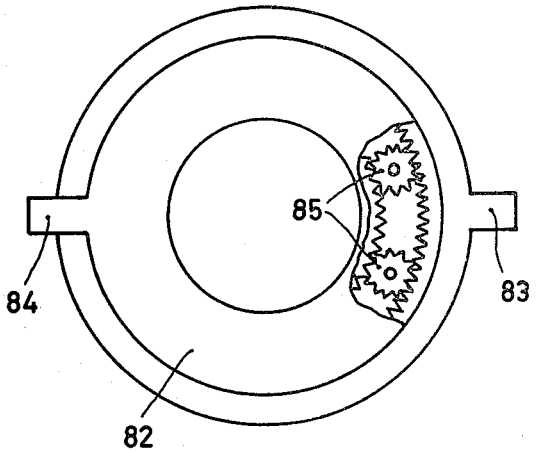

The magnetic quadrupole lenses can be obtained by means of coils or may consist of permanent magnetic materials, for example, magnetized Koerflex (a tradename of Messrs. Krupp) or vicalloy alloys which are described in "Fundamental Studies on Vicalloy Alloy", Cobalt 49, 196 (1970) or the alloys $Co_{49}Fe_{48}V_3$ and $Co_{85}Fe_{12}V_3$ or iron-molybdenum-nickel alloys or barium ferrite ($BaO.6Fe_2O_3$). By using two rings 80 and 81 magnetized as a quadrupole instead of one ring, as shown in FIG. 5, and assembling them so as to be rotatable relative to each other in a holder 82 as shown in FIG. 6 which holder 82 consists of two parts 83 and 84 which are rotatable relative to each other and which are coupled by toothed wheels 85, an adjustable magnetic quadrupole lens is obtained. By means of such a lens the electron beam can easily be focused in the focusing lens in one direction in such manner that the focusing lens has substantially no influence on the electron beam in that direction. This is the case when it is focused in the centre of the focusing lens.

The invention may also be used in colour display tubes.

Figure 7:
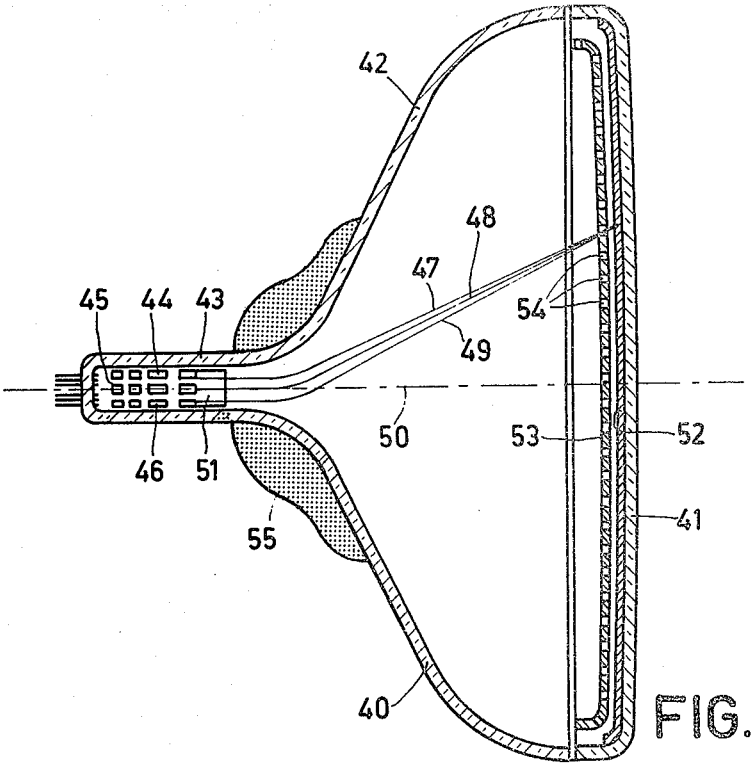
FIG. 7 is a longitudinal sectional view of a colour display tube according to the invention.

FIG. 7 shows such a colour display tube of the "in-line"-type as a longitudinal sectional view. In a glass envelope 40 which is composed of a display window 41, a cone 42 and a neck 43, three electron guns 44, 45 and 46 are provided in said neck and generate the electron beams 47, 48 and 49, respectively. The axes of the electron guns are situated in the plane of the drawing. The axis of the central electron gun 45 coincides substantially with the tube axis 50. The three electron guns open into centring sleeve 51 which is situated coaxially in the neck 43. The display window 41 comprises on its inside a large number of triplets of phosphor lines. Each triplet comprises a line consisting of a green-lyminescing phosphor, a line consisting of a blue-luminescing phosphor and a line consisting of a red-luminescing phosphor. All triplets together constitute the display screen 52. The phosphor lines are at right angles to the plane of the drawing. Positioned in front of the display screen is the shadow mask 53 in which a very large number of elongate apertures 54 is provided through which the electron beams 47, 48 and 49 emanate which each impinge upon only phosphor lines of one colour. The three electron beams which are situated in one plane are sub-electron beams of one ribbon-shaped electron beam which is deflected by the system of deflection coils 55 which together with the tube constitutes a self-converging system. Such a system of deflection coils with which a self-converging system can be made is described elaborately in the already mentioned U.S. Pat. No. 2,866,125 and is now used on a large scale in "in-line" type display tubes. Although a good convergence is obtained with such a system of deflection coils, an extra deflection defocusing nevertheless occurs because the individual electron beams are not ribbon-shaped. By using per gun the two quadrupole lenses according to the invention the deflection defocusing can be reduced.

Figure 8:
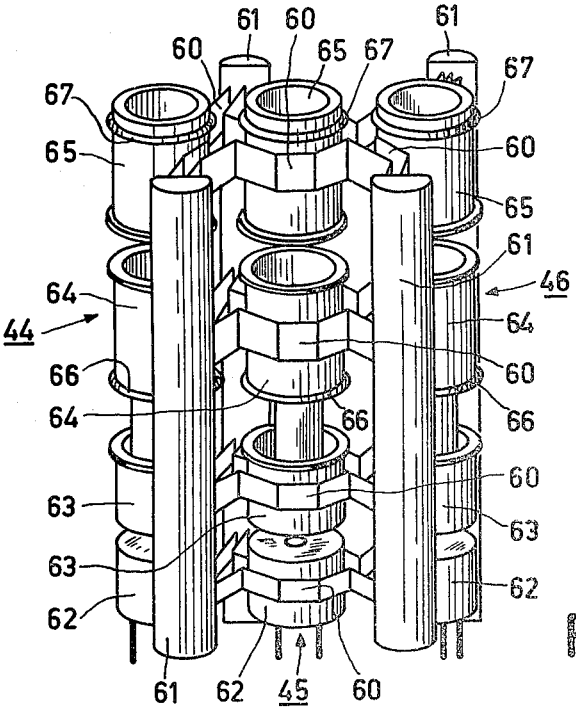
FIG. 8 is an elevation of three electron guns for the colour display tube shown in FIG. 7.

FIG. 8 is a perspective view of the three electron guns 44, 45 and 46. The electrodes of this triple electron gun system are positioned relative to each other by means of metal strips 60 which are sealed in glass assembly rods 61. Each gun consists of a cathode (not visible), a control electrode 62, a first anode 63 and the two lens electrodes 64 and 65 which together constitute the focusing lens. Coaxially around the lens electrode 64 a ring 66 magnetized as a quadrupole is provided which focuses the electron beam in the centre of the focusing lens formed by the electrodes 64 and 65 in the direction coinciding with the plane of the drawing of FIG. 7. The beam is defocused in the direction at right angles thereto. A second ring 67 magnetized as a quadrupole is provided coaxially around the lens electrode 65 and focuses the electron beam on the display screen 52 in the direction coinciding with the plane of the drawing of FIG. 7.

By means of a magnetization process as described in U.S. Pat. No. 4,220,897 rings of a magnetic halfhard material, for example the said Koerflex and the vicalloy alloys, may be magnetized as pure quadrupole lenses. The magnetized rings are then clamped around the lens electrodes. In a tube in which a ring magnetized as a multipole is also present for converging the three electron beams, as described, for example, in U.S. Pat. No. 4,220,897, which ring is magnetized from without through the neck of the tube, it is better to manufacture the magnetic quadrupole lenses from a magnetic hard material, for example barium ferrite, so as to prevent demagnetization.

The focusing lens which is formed by the electrodes 64 and 65 is a so-called bipotential lens. The focusing lens used in FIG. 1 is a so-called unipotential lens.

It will be obvious that the invention can also be used in colour display tubes having a so-called integrated electron gun system.

Figure 9:
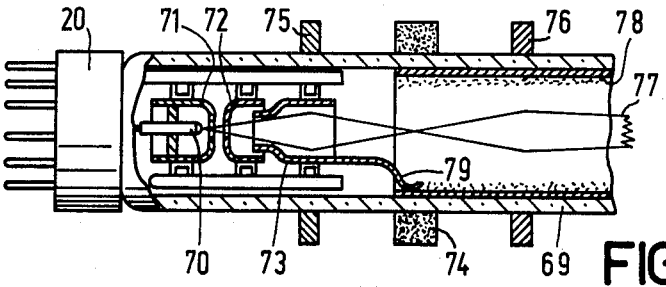
FIG. 9 is a part of a longitudinal sectional view of a device according to the invention.

FIG. 9 shows a part of a tube as shown in FIG. 1. An electron gun consisting of a cathode 70 which is succeeded by a control electrode 71, a first anode 72 and a second anode 73 is provided in the neck 69. A conductive coating 78 is provided on the inner wall of the neck and is connected electrically to the anode via contact springs 79, said coating being also connected to the aluminium film on the display screen. In this case the focusing lens is formed by a magnetic focusing lens 74 which is provided coaxially around the neck 69 between the two quadrupole lenses 75 and 76. The electron beam 77 of which again only the lines of intersection of the plane of the drawing with the beam envelope are shown is focused in the centre of lens 74 by the first quadrupole lens 75 and is then focused on the display screen by the second quadrupole lens 76. In the direction at right angles thereto the quadrupole lenses have a defocusing effect and the focusing is carried out by means of the magnetic focusing lens 74. The magnetic focusing lens 74 may be a lens as described in chapter 4, pages 119–113 of the already mentioned "Electron Optics in Television". Because in one direction the focusing lens does not exert any influence on the electron beam all the same, a magnetic quadrupole lens may also be used as a focusing lens which is rotated 90° relative to the remaining two quadrupole lenses.

Figure 10:
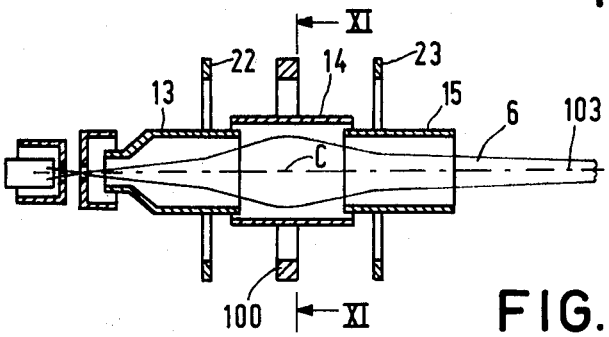
FIG. 10 is a sectional view analogous to FIG. 4 having an octupole lens for reducing the spherical aberration.
Figure 11:
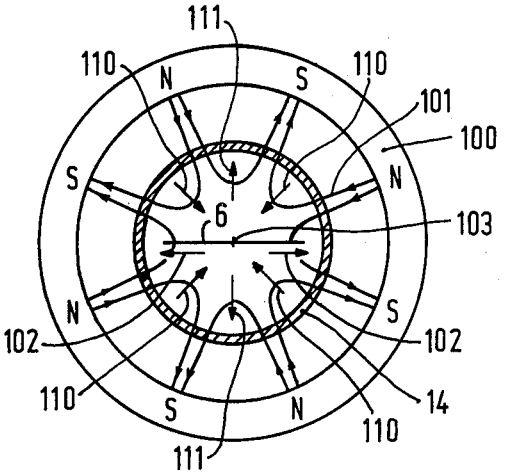
FIG. 11 is a sectional view on the line XI—XI of FIG. 10.

FIG. 10, as also FIG. 4*b*, is a longitudinal sectional view of an electron gun in accordance with the invention. In order to avoid complexity of the drawing, most reference numerals of components which have already been mentioned with reference to FIG. 4*b* have been omitted in this Figure. Of the electron beam 6 again the line of intersection of the beam envelope with the plane of the drawing is shown. As in FIGS. 4*a* and 4*b* the electron beam 6 is ribbon-shaped in the centre C. A line focus has been formed. By placing a magnetic octupole lens 100 around said line focus, as is shown in FIG. 11, the spherical aberration can be reduced. Such a magnetic octupole lens, like the quadrupole lenses, consists of a ring 100 of permanent magnetic material. This ring is cyclically magnetized north-south-north-south-north-south-north-south (N-S-N-S-N-S-N-S), so that a magnetic field is obtained of which a few field lines 101 are shown.

Figure 12:
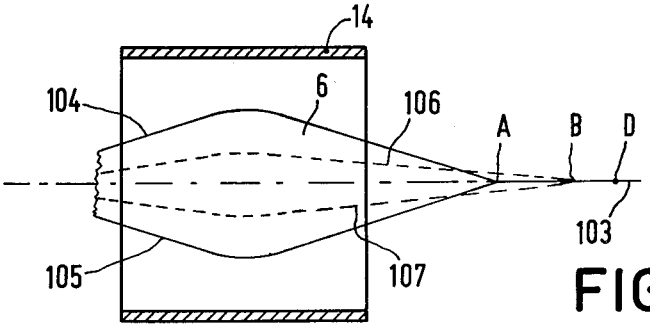
FIG. 12 shows with reference to a few rays of an electron beam what spherical aberration is and how it is reduced.

FIG. 12 shows the effect of spherical aberration. When the quadrupole lens 23 is omitted, all the rays of the electron beam 6 are focused on the axis 103 by the focusing lens. The place where the rays are focused proves to depend on the distance from the ray to the axis 103. As a result of this, the more outwardly situated rays 104 and 105 intersect the axis closer to the focusing lens in the point A than the more inwardly situated rays 106 and 107 which intersect the axis in the point B. This effect is termed positive spherical aberration. Negative spherical aberration also exists but this never occurs in electrostatic and magnetic lenses.

By providing according to the invention a magnetic octupole lens 100 around the centre C in which the line focus of the electron beam is situated (see FIGS. 10 and 11) in such manner that defocusing forces which are denoted by the arrows 102 are operative in the plane of the ribbon-shaped electron beam, the spherical aberration can be reduced. This is possible because these forces in an octupole are proportional to the third power of the distance to the axis 103, while spherical aberration is a third order error which is also proportional to the third power of the distance to the axis 103. The forces 110 directed inwards are not effective in this case because at the area where they occur no rays of the electron beam are present. As a result of this the outwardly directed forces 111 have no effect either.

Since by means of such an octupole stigmator the outermost rays 104 and 105 as shown in FIG. 12 are defocused slightly more than the rays 106 and 107, the points A and B will coincide in point D and the spherical aberration is thus reduced or removed.

What is claimed is:

1. In a device for displaying pictures comprising a display tube having a system of deflection coils, which display tube comprises an evacuated envelope having therein an electron gun for generating at least one electron beam and a display screen, which electron beam is focused on the display screen by means of a focusing lens, over which display screen the electron beam is deflected in two mutually perpendicular directions by means of the system of deflection coils, the improvement wherein the system of deflection coils is a self-converging system of deflection coils and viewed in the direction of propagation of the electron beam a first quadrupole lens is provided around the electron beam before the focusing lens and focuses the electron beam in a first direction in the centre of the focusing lens, said first direction coinciding substantially with the direction in which the focusing is substantially independent of the deflection by the system of deflection coils, and after the focusing lens a second quadrupole lens is also provided which focuses the electron beam in the first direction on the display screen so that the focusing in said first direction takes place substantially by the two quadrupole lenses and by the focusing lens in the direction at right angles thereto.

2. A device as claimed in claim 1, wherein the focusing lens is also a quadrupole lens which is rotated 90° relative to the two said quadrupole lenses.

3. A device as claimed in claim 1, wherein at least one of the quadrupole lenses is a magnetic quadrupole lens.

4. A device as claimed in claim 3, wherein the magnetic quadrupole lens consists of a ring of permanent magnetic material magnetized as a quadrupole and provided around the electron beam.

5. A device as claimed in claim 3, wherein the magnetic quadrupole lens consists of two rings of permanent magnetic material which are magnetized as quadrupoles and can be rotated relative to each other.

6. A device as claimed in any one of the claims 1 to 5, wherein, viewed in the direction of propagation of the electron beam at the level of the centre of the focusing lens, a magnetic octupole lens is provided coaxially around the electron beam and has a defocusing effect in the said first direction and has a stigmator action.

7. A device as claimed in any one of the claims 1 to 5, wherein the display tube is a tube for displaying alpha numerical characters, symbols and figures.

8. A device as claimed in any one of the claims 1 to 5, wherein the display tube is a projection television display tube.

9. In a display tube comprising an evacuated envelope having therein an electron gun for generating at least one electron beam and a display screen, which electron beam is focused on the display screen by means of a focusing lens, the improvement wherein, viewed in the direction of propagation of the electron beam, a first quadrupole lens is provided around the electron beam before the focusing lens, which electron beam focuses in a first direction in the centre of the focusing lens, and after the focusing lens a second quadrupole lens is also provided which also focuses the electron beam in the first direction on the display screen so that the focusing in said first direction takes place substantially by the two quadrupole lenses and in the direction at right angles thereto takes place by the focusing lens.

10. A display tube as claimed in claim 9, wherein the focusing lens is also a quadrupole lens which is rotated 90° relative to the said two quadrupole lenses.

11. A display tube as claimed in claim 9 wherein at least one of the quadrupole lenses is a magnetic quadrupole lens.

12. A display tube as claimed in claim 11 wherein the magnetic quadrupole lens consists of a ring of permanent magnetic material which is magnetized as a quadrupole and is provided around the electron beam.

13. A display tube as claimed in any one of the claims 9 to 12 wherein, viewed in the direction of propagation of the electron beam at the level of the centre of the focusing lens, a magnetic octupole lens is provided coaxially around the electron beam and has a defocusing effect in the said first direction and has a stigmator action.

14. In a picture display tube having an electron gun for generating at least one electron beam, a display screen, a focusing lens for focusing the electron beam on the display screen, and a self-converging system of deflection coils for deflecting the electron beam in two mutually perpendicular directions over the display screen, the improvement comprising:

a first quadrupole lens provided around the electron beam before the focusing lens for focusing the electron beam in a first direction in the center of the focusing lens, said first direction coinciding substantially with the direction in which the focusing is substantially independent of the deflection by the system of deflection coils; and a second quadrupole lens provided around the electron beam after the focusing lens for focusing the electron beam in the first direction on the display screen so that the focusing of the electron beam is effected substantially by the two quadrupole lenses in the first direction and by the focusing lens in the direction at right angles thereto.

* * * * *